United States Patent [19]

Matsubara

[11] Patent Number: 4,622,879

[45] Date of Patent: Nov. 18, 1986

[54] ELECTRONIC MUSICAL INSTRUMENT

[75] Inventor: Akinori Matsubara, Tokyo, Japan

[73] Assignee: Casio Computer Co., Ltd., Tokyo, Japan

[21] Appl. No.: 709,984

[22] Filed: Mar. 11, 1985

Related U.S. Application Data

[63] Continuation of Ser. No. 433,429, Oct. 8, 1982.

[30] Foreign Application Priority Data

Oct. 12, 1981 [JP] Japan ..... 56-162945

[51] Int. Cl.[4] ..... G10F 1/00

[52] U.S. Cl. ..... 84/1.03; 84/124

[58] Field of Search ..... 84/1.28, 1.01, 1.03, 84/1.24

[56] References Cited

U.S. PATENT DOCUMENTS

| | | | |
|---|---|---|---|
| 3,878,750 | 4/1975 | Kapps | 84/1.03 |
| 4,361,067 | 11/1982 | Ishii | 84/1.03 |
| 4,368,989 | 1/1983 | Kawashima | 84/1.03 |
| 4,454,796 | 6/1984 | Inoue et al. | 84/1.28 |
| 4,491,049 | 1/1985 | Mizuta et al. | 84/1.28 |

FOREIGN PATENT DOCUMENTS

| | | |
|---|---|---|
| 2645641 | 4/1977 | Fed. Rep. of Germany . |
| 2062341 | 5/1981 | United Kingdom . |

OTHER PUBLICATIONS

Forester W. Isen, "An Electronic Music Synthesizer Controlled by Digital Logic," Master of Engineering thesis, University of Louisville, Aug., 1978, pp. i, ii, 4–28.

"Synclavier II from New England Digital", adv. in Computer Music Journal, vol. 4, No. 4, Winter 1980, p. 89.

*Primary Examiner*—Forester W. Isen

*Attorney, Agent, or Firm*—Frishauf, Holtz, Goodman & Woodward

[57] ABSTRACT

The addresses of memory positions in a RAM stored with a series of tone data corresponding to a preselected musical piece, are sequentially stepped by a backward key or a forward key in the backward or forward direction, and the tone corresponding to the tone data stored in a stepped address is generated, for each actuation of the corresponding key, under the control of CPU. Upon actuation of a delete key, the tone corresponding to the tone data stored in an address preceding the currently stepped address by one, is generated through the controlling operation of the CPU. Subsequently, the tone data stored in an address succeeding by one the current address is written into that address, and the tone data of the addresses succeeding the address having its content written are sequentially shifted by one address in the backward direction, respectively.

6 Claims, 14 Drawing Figures

ELECTRONIC MUSICAL INSTRUMENT

This application is a continuation of application Ser. No. 433,429, filed Oct. 8, 1982.

BACKGROUND OF THE INVENTION

This invention relates to an electronic musical instrument which has a memory for storing a series of tone data, and which functions to optionally correct and delete the tone data stored in the memory or to insert a prescribed tone data into the memory.

In recent years, an electronic musical instrument has been made commercially available which is capable of storing in its memory musical tone data preselected by a user and, in performance, allowing the tone data to be read out in turn from the memory through operating a one-key play key or auto-play key to allow the tone generation in turn, thus allowing an automatic performance of the music.

This type of electronic musical instrument has a display means at a position close to, for example, its keyboard, on which is displayed the number of steps increasing each time the user inserts the tone data into the memory. Through reading a note or notes by the user from his score and actuating in turn the key corresponding to that note or notes at a prescribed timing and interval, the corresponding tone data is written into the memory. Assume that, at this time, a misreading by the user of the note frequency occurs, which causes the writing of erroneous tone data into the memory. In such a case, the step number is returned or reset to "0" and the memory address is thereby reset to the foremost address. Subsequently, while viewing the display of the step number, the memory address is forwardly stepped-up to an address corresponding to the erroneously input memory position to correct the memory content at that address. Where the missed tone data is inserted, the correct tone data already written is once deleted and thereafter the deleted tone information is inserted into a memory position immediately succeeding the missed memory position. Thus, there is a shortage of one memory position. That is, the correct tone data already input into the memory positions of the addresses succeeding to the address corresponding to said missed memory position have to be totally deleted and input once again. More specifically, while deleting the memory contents by depressing the delete key, the address position is returned to the address corresponding to the missed memory position and thereafter the correct tone information is input into the succeeding memory positions.

In any of the above-mentioned methods, however, it is uncertain or unclear whether or not the step number displayed as a result of restoring the address position corresponds to the note erroneously inputted, with a result that difficulties are encountered in performing the operation of correctly restoring the address position. Further, in the case of inputting the missed tone data, even the previous tone data correctly input is deleted, with the result that the time and labour necessary for the inputting operation are duplicated.

Further, where the delete key is used, it is considered useful to inform the operator of a completion of the deletion of tone data by means of a buzzer. In this prior art, however, the contents of the tone data as deleted fail to be confirmed, particularly when the delete key, is depressed several times consecutively. Such the inconveniences involved in the prior art.

SUMMARY OF THE INVENTION

Accordingly, the object of the invention is to provide an electronic musical instrument arranged to enable an extremely easy and quick correction, insertion and deletion of tone data stored in its memory.

According to the invention, the above object is achieved by an electronic musical instrument which comprises input means for inputting in turn a series of tone data constituting a preselected musical piece, memory means for storing the tone data inputted from the input means, address designating means for designating in turn the addresses of the memory means in accordance with said series of tone data, address renewing means for stepping the address of the memory means forward or backward through a manual operation, and tone generating means for generating a tone corresponding to the tone data stored in a memory position of the address renewed by the address renewing means.

DETAILED DESCRIPTION OF THE PREFERRED EMBODIMENT

Figure 1:
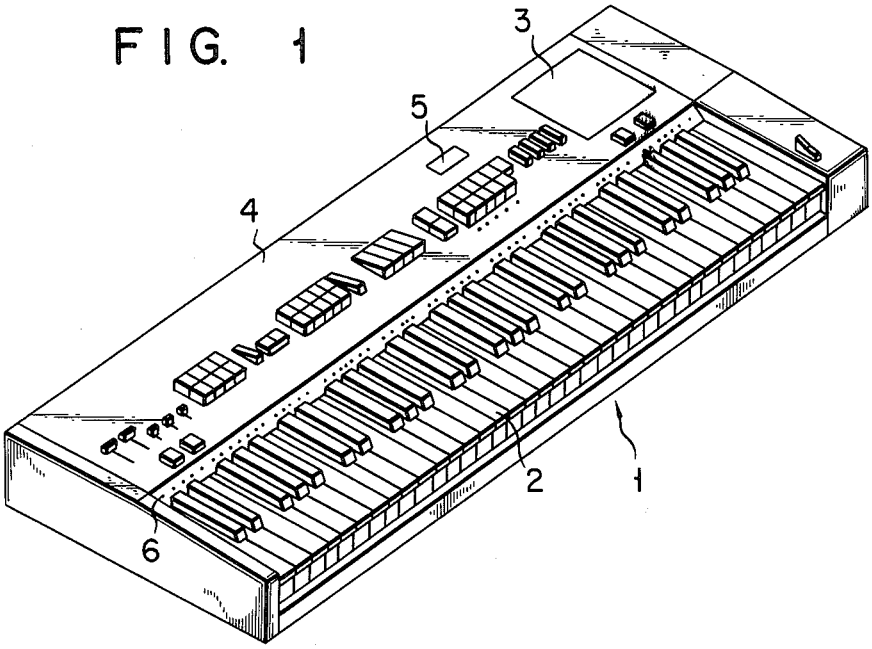
FIG. 1 shows the outer view of an electronic musical instrument according to one embodiment of this invention.

FIG. 1 shows the outer view of an electronic musical instrument. The electronic musical instrument has a main body 1 in which there are disposed a keyboard 2 having a plurality of keys, a sounding section 3, a switch operating section 4, and a display section 5. In the proximity of the keyboard 2, a plurality of display units 6 are disposed correspondingly to keys of the keyboard 2. The display units 6 are each comprised of a light emitting diode.

Figure 2:
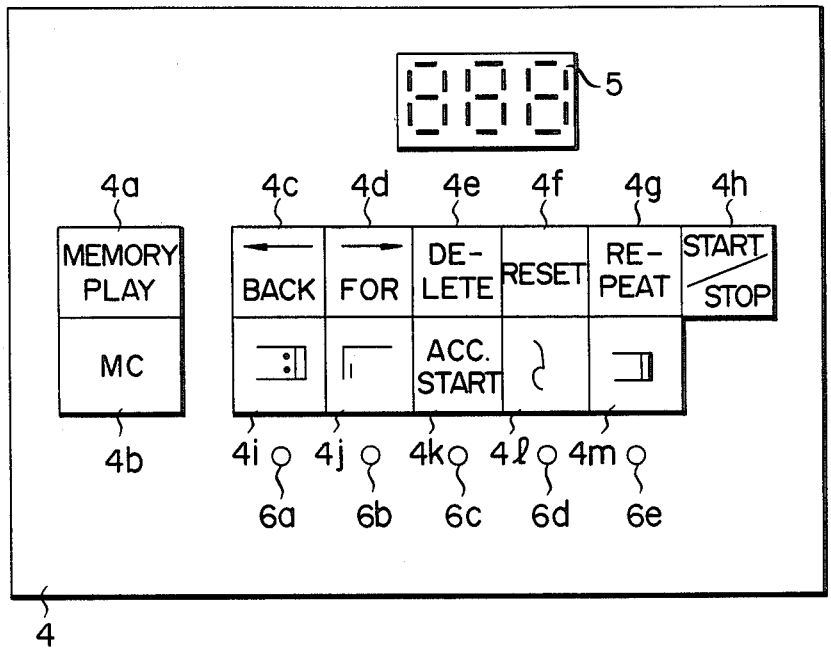
FIG. 2 shows a main construction of the operating section and a construction of the display section of the instrument of FIG. 1.

FIG. 2 shows a main construction of the switch operating section and a construction of the display section 5. In the switch operating section 4, there are disposed a memory play key 4*a* for setting the operation to a memory/play mode in which to write into a memory the tone data constituting a preselected musical piece and in which to read tone data to perform the musical piece, an MC key 4*b* for setting the operation to a mode in which to effect the inputting into the memory by means of a bar code reader (not shown), a backward key 4c, forward key 4d, and delete key 4e as later described. Also shown are a reset key 4f for resetting the address position of the memory to a top or foremost address, a repeat key 4g which is used, at the time of reading the contents of the memory for automatic performance of the musical piece, to set the frequency of repeating the automatic performance in accordance with the frequency of operation, a start/stop key 4h for starting/stopping the automatic performance, a return completion key 4i which is used, at the time of repeating a desired portion of the musical piece, to effect the inputting operation with respect to the end of that desired portion, a return commencement key 4j used to effect the inputting operation with respect to the beginning of the desired portion of the musical piece, an accompaniment (ACC) start key 4k which is used, at the time of effecting the automatic performance, to cause an automatic starting of the rhythm performance and accompaniment performance from a midpoint, a rest-note key 4l for inputting a rest note, and an end mark key 4m for inputting an end mark of the music. The backward key 4c, forward key 4d and delete key 4e are used, for example, to correct the contents written into the memory, the backward key 4c being used to step the address of the memory backward for each actuation, on an address by address basis, the forward key 4d being used to step the address of the memory forward for each actuation, on an address by address basis, the delete key 4e being used to delete the content of a corresponding address or memory-position each time it is actuated. Further, in the proximity of the return completion key 4i, return commencement key 4j, ACC start key 4k, rest-note key 4l and end mark key 4m, the display units 6a to 6e are disposed correspondingly.

Figure 3:
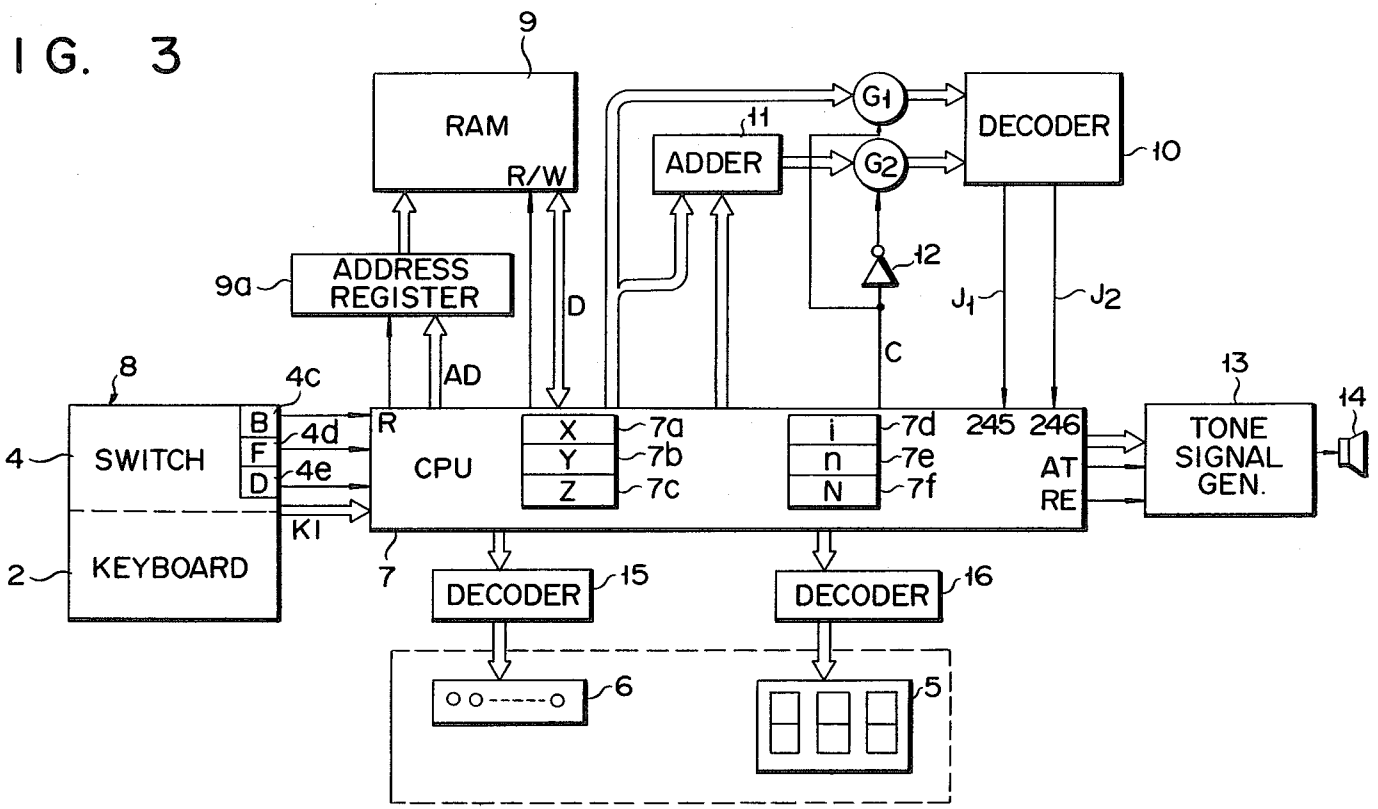
FIG. 3 shows the operational system of the instrument of FIG. 1 as a whole.
Figure 4A:
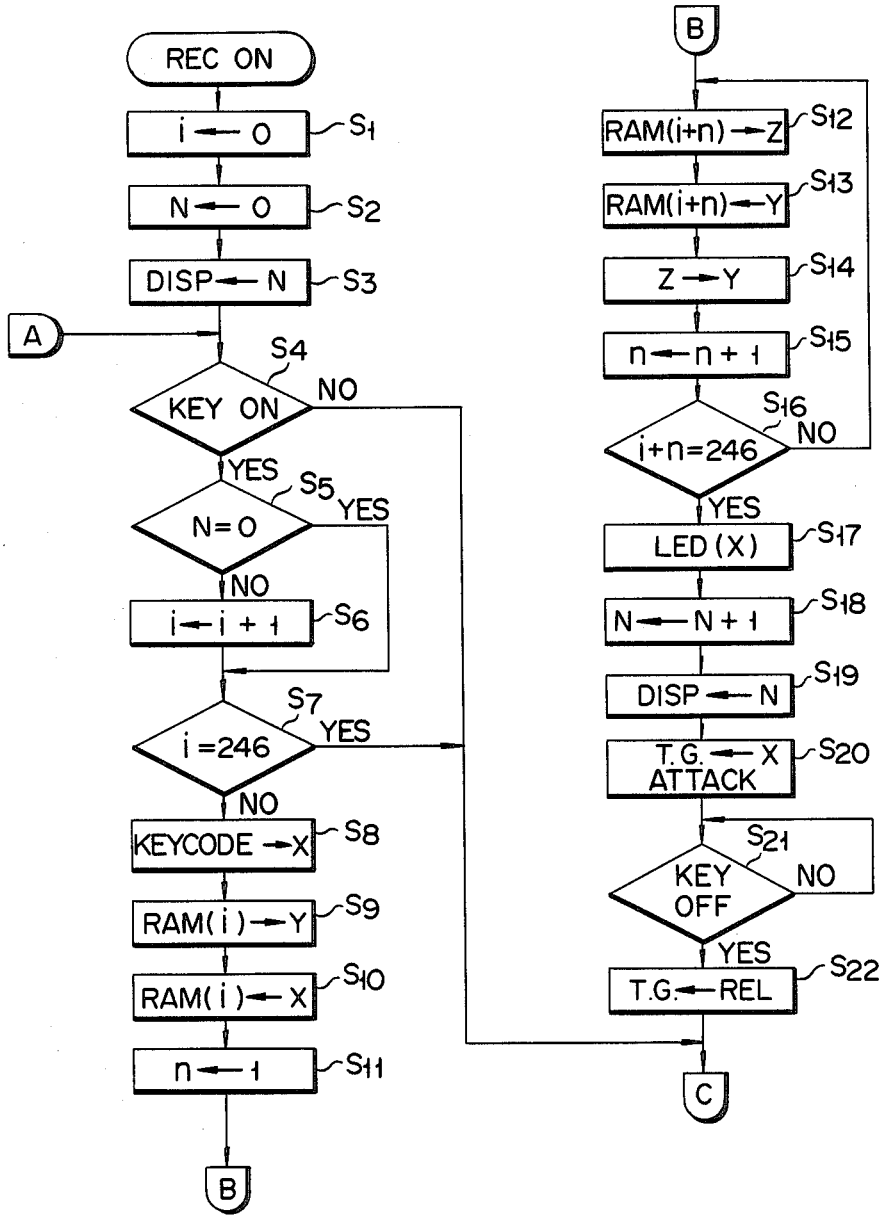
FIGS. 4A and 4B are flow charts for explaining the operation of the electronic musical instrument shown in FIG. 1.
Figure 4B:
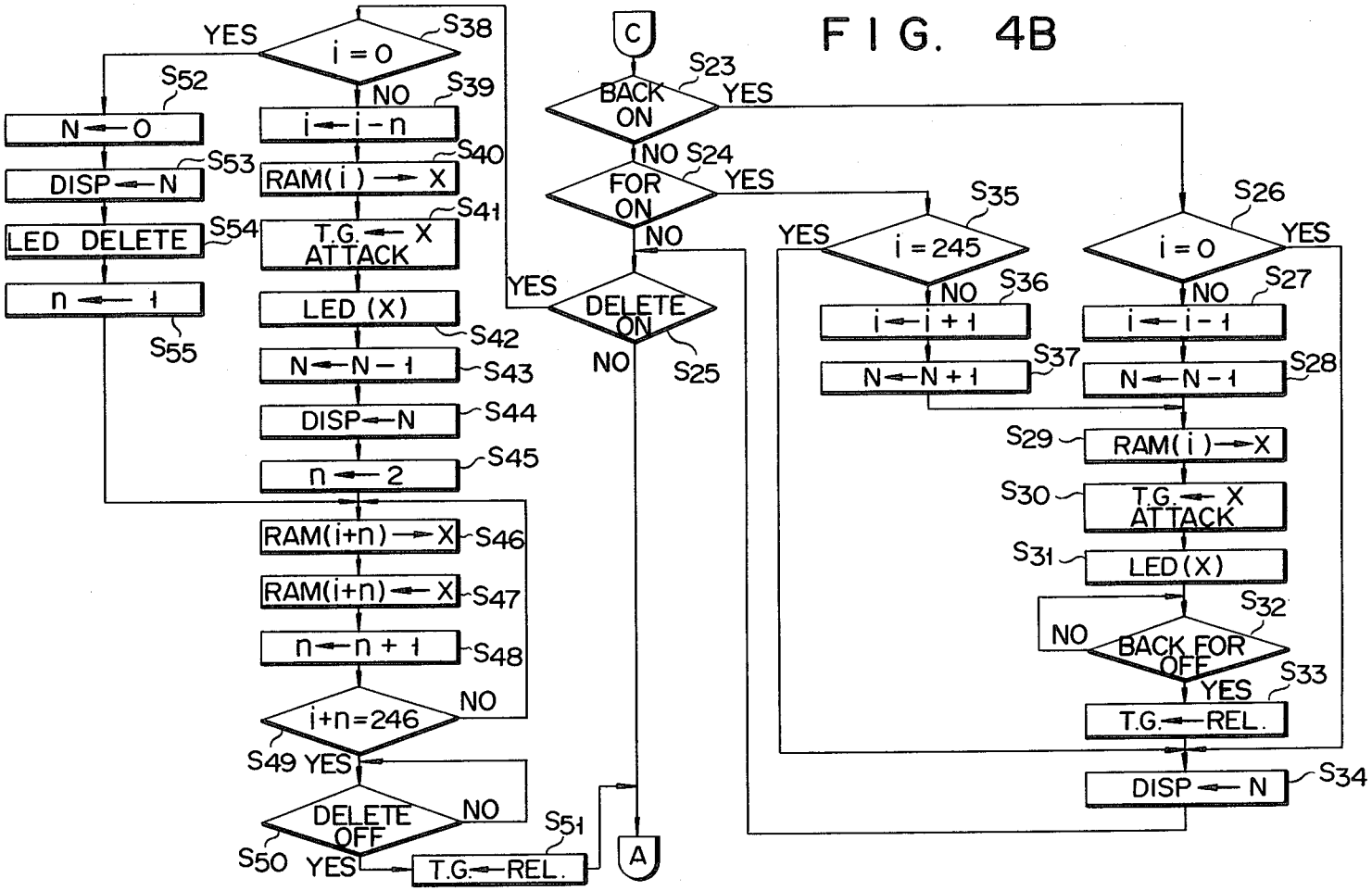
Figure 5:
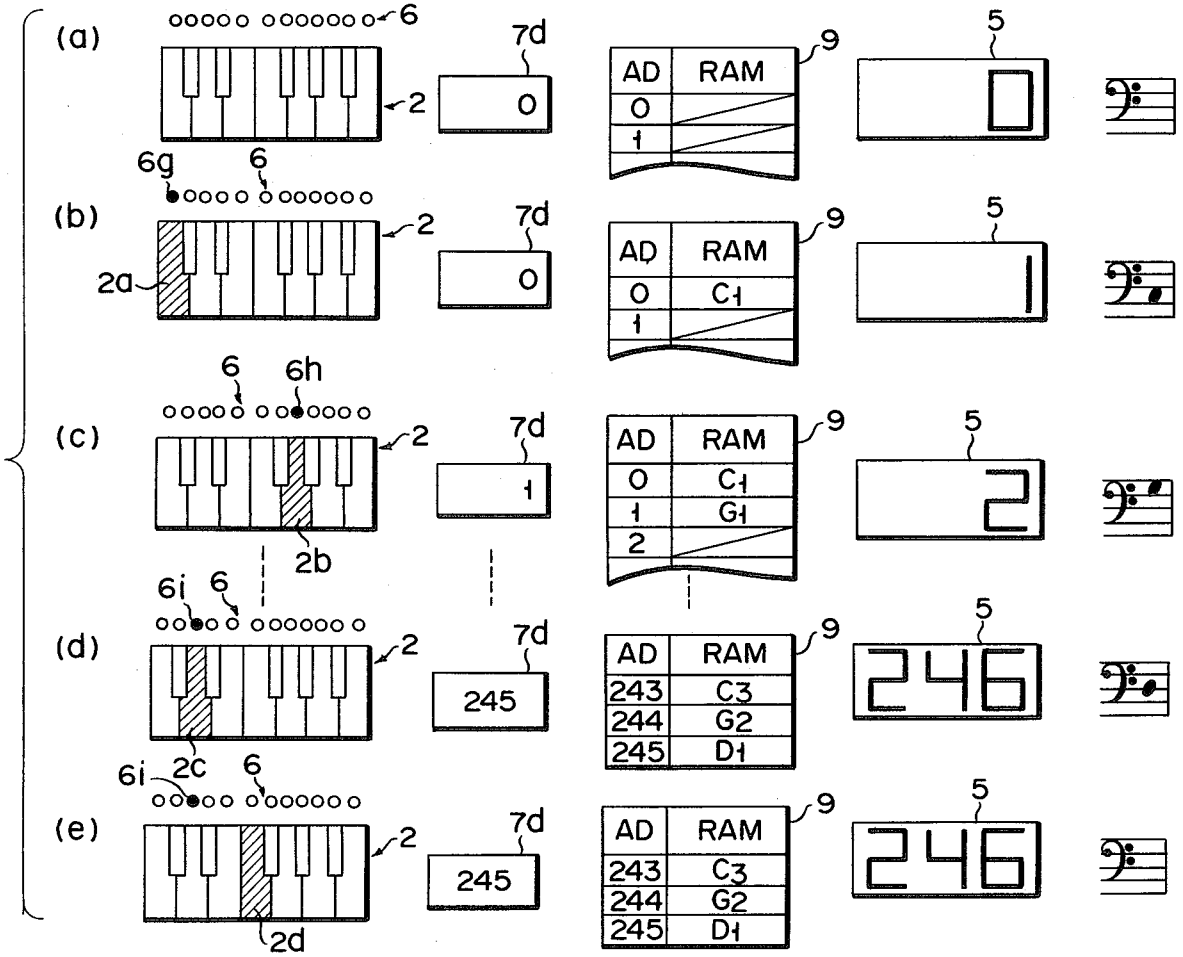
FIGS. 5*a* to 5*e* show the correspondence of the key of the keyboard which is actuated when writing the tone data of a preselected musical piece into the memory, to the status of a corresponding display unit disposed in the proximity of the keyboard, the content of the i register, an content of a RAM, the status of the display section, and the tone generation.

FIG. 3 shows the operational system as a whole of the electronic musical instrument shown in FIG. 1. A CPU (central processing unit) 7 for controlling the various operations of the electronic musical instrument is supplied with a key input signal KI from an input section 8. This key input signal KI consists of a key code signal output from the keyboard 2 in correspondence to the key actuated, and a key-actuation signal output from the switch control section 4 in correspondence to the key actuated. The CPU 7 is also supplied with the key-actuation signals output from the switch control section 4 corresponding to the actuations of the backward key 4c, forward key 4d and delete key 4e. The CPU 7 is provided with an X register 7a used to display and to transfer the tone data, Y and Z registers 7b, 7c for temporary holding of the data therein, i and n registers 7d, 7e for address designation of RAM (random access memory) as later described, and an N register 7f for display of the number of steps in which the address of the RAM is stepped. The CPU 7 supplies the address data AD to an address register section 9a in accordance with the contents of the i register 7d, or the contents of the i register 7d and n register 7e. The output of this address register section 9a designates the address of the RAM 9. Further, the contents of the address register section 9a are reset in accordance with a reset signal R outputted from the CPU 7.

The RAM 9 has a memory capacity corresponding to the 0 to 245th addresses, and, by being supplied as a data D with the key code signal output in correspondence with the key actuation of the keyboard 2 after this key code signal is transferred to X register 7a, writes that data D sequentially into a memory position corresponding to its designated address and stores it therein. Note here that a tone length or interval code signal is also storable in the RAM 9. The data D read from the RAM 9 is transferred to any one of the X, Y and Z register 7a, 7b, 7c. The read and write operation with respect to the RAM 9 is made executable in accordance with read/write signals R/W output from the CPU 7.

Meanwhile, the contents of the i register 7d output from the CPU 7 are supplied through a gate circuit G1 to a data judgement section 10 comprised of, for example, a decoder and are also supplied to an adder circuit 11. The adder circuit 11 adds up the contents of the n register 7e and the contents of the i register 7d, both the contents being supplied thereto from the CPU 7, and supplies this sum to the decoder 10 through a gate circuit G2. A gate control signal C output from the CPU 7 is applied directly to the gate circuit G1 and also applied to the gate circuit G2 through an inverter 12 so that the gate circuits G1 and G2 may be alternatively opened. When the output data of the gate circuit G1 or G2 is "245" (the greatest address of the RAM 9), the decoder 10 produces a signal J1, and when the data is "246" (greater than said greatest address of the RAM 9), the decoder 10 produces a signal J2. And the decoder 10 applies these output signals J1 and J2 to corresponding input terminals "245" and "246", respectively, of the CPU 7.

Further, the CPU 7 produces a release signal RE to a tone signal generator 13 after supplying the contents (tone data) of the X register 7a to it together with an attack signal AT. The tone signal output from the tone signal generator 13 is sent to a loudspeaker 14.

Further, the CPU 7 supplies the contents of the X register 7a to a decoder 15, the output of which is supplied to the display unit 6 to selectively light the same. Further, the CPU 7 supplies the contents of the N register 7f to a decoder 16, the output of which is supplied to the display section 5 to cause the same to digitally display the step number or address of the RAM 9. Note here that the electronic musical instrument with keyboard of this embodiment permits, in a normal-play mode an output of the sound corresponding to the actuated key.

There will now be described the operation of the above embodiment with reference to FIGS. 4A, 4B to FIG. 13. Initially, the operation of writing a prescribed tone data in turn into the RAM 9 is described in detail with reference to FIG. 5. By actuation of a prescribed key after actuating the memory play key 4a, the RAM 9 is set to the REC mode. In this REC mode, the operation is performed in accordance with the flow charts shown in FIGS. 4A and 4B. In steps S1 and S2, the initial setting is carried out. That is, in the step S1, "0" is transferred to the i register 7d and subsequently is transferred, in the step S2, to the N register 7f, thereby clearing the contents of the i and N registers 7d, 7f. Then, the operation is shifted to step S3, in which the content of the N register 7f is sent to the display section 5, and the address or step number of the RAM 9 is digitally displayed. As a result, the state of operation actualized in the initial setting is as shown in (a) in FIG. 5. Note here that in each of FIGS. 5a to 5e the actuating or actuated keys of the keyboard 2 and the display units 6 disposed in the proximity of the keyboard 2, the content of the i register 7d, the content of the RAM 9, the display status of the display section 5, and the sound generation from the loudspeaker 14 are shown from the left side of the illustration in the order mentioned. Thus, in the state of initial setting, as shown in (a) in FIG. 5, the display units 6 are unlit, as indicated by a whitened circle, the RAM 9 has no data written therein, the address register section 9*a* has a content of "0", and no sound generation is effected.

Subsequently, the operation is shifted to next step S4, in which it is judged whether or not the keyboard 2 is subjected to the key actuation or is keyed on. The key-on judgement is made by whether or not the key code signal has been input from the keyboard 2. Since in the illustrated embodiment of (b) in FIG. 5 the key 2*a* of tone pitch C1 (indicated in the drawing by oblique lines) is actuated, the operation is advanced to next step S5, in which it is judged whether or not the content of the N register 7*f* is "0". When in step S5 it has been judged that the content of the N register 7*f* is not "0", the operation is advanced to step S6, in which "1" is added to the content of i register 7*d*, thereby to cause an increment in the same. Since in this mode the content of the N register 7*f* is "0" the operation is advanced to step S7 from step S5. The step S7 is executed also upon completion of the step S6 operation, and it is judged whether or not the content of i register 7*d* is "246", by being supplied to the decoder 10 through the gate circuit G1. That is, in step S7, detection is made on the overflow of data with respect to the memory capacity of the RAM 9. Since at this stage of operation the content of N register 7*f* is "0" and step S6 is skipped, the content of i register 7*d* becomes "0" as shown in (b) in FIG. 5, with the result that the operation is advanced from step S7 to step S8. In this step S8, the key code (tone data) of tone pitch C1 output from the keyboard 2 is transferred to X register 7*a*. Subsequently, the operation is advanced to step S9, in which the data, "0" at this stage of operation, stored in an area or RAM (i) of the RAM 9 address-designated by the content of i register 7*d* is transferred into Y register 7*b* and allowed to stay therein. Next, the operation is advanced to step S10, in which the content of X register 7*a* is transferred into the area RAM (i) and is written and stored therein. At this stage of operation, since the key code of tone pitch C1 is previously written as above in X register 7*a*, it is written into the 0 address of the RAM 9 as shown in (b) in FIG. 5. After completion of the step S10, the operation is advanced to step S11, in which the "1" is preset into n register 7*e*. Subsequently, the operation is advanced to step S12, in which the contents of the i and n registers 7*d*, 7*e* are added up and the content of the area RAM (i+n) of the RAM 9 address-designated by that sum, namely "1", is transferred into Z register 7*c* and allowed to stay therein. Next, in step S13, the content of the area RAM (i) allowed in step S9 to stay in Y register 7*b*, is transferred into the area RAM (i+n). Subsequently, the content of the area RAM (i+n) allowed in said step S12 to stay in Z register 7*c* is transferred into Y register 7*b*. In the subsequent step S15, "1" is added to the content of n register 7*e*, thereby to cause an increment in the n register 7*e*. In the subsequent step S16, the data of the area RAM (i+n) previously obtained by the adding operation of the adder 11 is supplied to the decoder 10 through gate circuit G2 for determining whether or not that data is "246". When the data is not "246", the operation is returned to step S12 and the operations in steps S12 to S16 are repeatedly carried out. Thus, the contents of the RAM 9 are advanced or forwardly shifted by one address, or from one address to the next greater address. This data advancing operation becomes necessary when inserting a prescribed tone data into the RAM 9. On the other hand, when in step S16 "246" is detected, the output signal J2 is produced from the decoder 10. Upon production of the signal J2, the CPU 7 performs its operation in step S17, in which the key code of tone pitch C1 stored in X register 7*a* is supplied to the display unit 6, with a result that, as shown in (b) in FIG. 5, the display unit 6*g* or LED (light emitting diode) corresponding to the key of tone pitch C1, is lit. Subsequently, the operation is advanced to step S18, in which "1" is added to the content of N register 7*f* to cause an increment in the content thereof. Consequently, the content of N register 7*f* is renewed to "1", and in the subsequent step S19 the renewed content of same is supplied to display section 5. Thus, as shown in (b) in FIG. 5, "1" is digitally displayed. Subsequently, the operation is advanced to step S20, in which the key code of tone pitch C1 stored in X register 7*a* is supplied to the tone generator 13 together with the attack signal AT. As a result, as shown in (b) in FIG. 5, the sound having the pitch of C1 starts to be generated. In the subsequent step S21, it is judged whether or not the key 2*a* of tone pitch C1 is keyed off or is released from its actuation. The operation is delayed until that key is keyed off. When that key is released, the operation is advanced to step S22, in which the release signal RE is supplied to the tone generator 13, thereby stopping the tone generation.

Upon stopping of the tone generation, the operations under steps S23 to S25 are executed. That is, in steps S23, S24 and S25 it is judged whether or not the backward key 4*c*, forward key 4*d* and delete key 4*e* are keyed on, respectively. When any of these keys is not actuated, the operation is returned to step S4, in which it is judged whether or not the next key is keyed on. When the next key is not keyed on, the operation is returned to step S23, whereby the operations under steps S23, S24 and S25 are circularly performed. When the key 2*b* of tone pitch G1 is actuated under this condition, the operations under steps S5 to S22 are sequentially carried out, with the result that the address register section 9*a* is subjected, in step S6, to increment of the content by "1". Thus, as shown in (c) in FIG. 5, the key code of tone pitch Gl is written into the first address of the RAM 9, "2" is displayed in the display section 5, the display unit 6*h*. corresponding to the key of tone pitch G1 is energized, and a tone having the pitch of C1 is generated. When performance keys in the keyboard are subsequently keyed on in turn and in the same manner, and data of the key 2*c* of tone pitch D1 is written into the address 245 of the RAM 9, the resultant operational status is as shown in (d) in FIG. 5. When it is now assumed that the key 2*d* of tone pitch F1 be further depressed from the state wherein the tone data is already written in each address of the RAM 9 in the aforementioned way, since the content of the i register 7*d* is "246" by the operation under step S7, the operation is advanced to steps S23, S24 and S25 and is returned to step S4 once again. Accordingly, as shown in (e) in FIG. 5, the unit 6*i* of the display unit 6 corresponding to the key of tone pitch D1 written in the address No. 245 is lit, the content of the i register 7*d* remains "245", and the contents of the RAM 9 and N register 7*f* are also kept unchanged. For this reason, the tone of pitch F1 is not generated. In this way, when the tone data constituting a preselected musical piece is written into the RAM 9, it is so done in a sequential order by actuating the keys in turn in accordance with the score of the musical piece. And during this writing operation the display unit 6 corresponding to the actuated key is lit and the tone corresponding to the same is simultaneously sounded. Thus, it is possible to confirm the tones being written into the RAM 9, both visually and aurally.

Next, the operation performed when the backward key is keyed on will be described in detail with reference to FIGS. 6 and 7. Assume now that, as shown in (a) in FIG. 6, the key code of tone pitch F1 stored in the first address of the RAM 9 is read and the display unit 6*j* corresponding to the key 2*d* of tone pitch F1 is kept lit. When under this state the backward key 4*c* is once keyed on, the operation is advanced to step S23 through step S4 and is further advanced to step S26, in which whether the content of i register 7*d* is "0" is judged. Since at this stage of operation the content of i register 7*d* is "1" as shown in (a) in FIG. 6, the operation is advanced to step S27, in which "1" is subtracted from the content of i register 7*d*. Subsequently, the operation is advanced to step S28, in which "1" is subtracted from the content of N register 7*f*, thereafter advancing to step S29. In the step S29, the content of the area RAM (0), or the key code of the tone pitch C1, is transferred to X register 7*a*. Next, the operation under step S30 is executed to start the generation of the sound having the pitch of C1. In the subsequent step S31, the display unit 6*g* corresponding to key 2*a* of tone pitch C1 goes ahead to the next step S32. In the step S32, it is judged whether or not backward key 4*c* or forward key 4*d* is keyed off, the operation being delayed until it is keyed off. When the backward key 4*c* is keyed off, the operation is advanced to step S33, in which the sound generation is stopped. The operation is subsequently advanced to step S34, in which the data "1" of N register 7*f* is displayed in the display section 5. Accordingly, when once actuating the backward key 4*c* under the state shown in (a) in FIG. 6, the display and sound generation are as shown in (b) in FIG. 6.

Upon completion of the step S34 operation, the operation is returned to step S4 through step S25. If, thereafter, no further key actuation is carried out, the operations of steps S23, S24, S25 and S4 are circularly carried out. When the key 2*c* of tone pitch D1 is now keyed on, the operations of steps S5 to S22 are sequentially carried out. That is, since at this stage of operation the content of the N register 7*f* is "1" as mentioned above, the operation is advanced to step S6 from step S5. In step S6, the content of i register 7*d* is increased to "1" and the operation is advanced through steps S7 to step S8 in which the key code of tone pitch D1 is transferred to X register 7*a*. Subsequently, in step S9, the key code of tone pitch F1 stored in the area RAM (i), or the first address of RAM 9, is transferred into Y register 7*b* and allowed to stay therein. In the subsequent step S10, the key code of tone pitch D1 transferred into X register 7*a* is written into the first address of the RAM 9. In the subsequent step S11, "1" is preset to n register 7*e*, the operation being advanced to the next step S12, in which the content stored in the area RAM (i+n), or the second address of the RAM 9, is allowed to stay in Z register 7*c*. Since at this stage of operation no data is written in the second address of the RAM 9, the content of Z register 7*c* is "0". Subsequently, the operation is advanced to step S13, in which the key code of tone F1 allowed to stay in Y register 7*b* is written into the second address of the RAM 9. Thereafter, the operations of steps S12 to S16 are repeatedly carried out through steps S12 to S16. As a result, the contents of the addresses succeeding to the first address of the RAM 9 are shifted forward by one as shown in (c) in FIG. 6. Upon completion of this shifting operation, the operations under steps S17 to S22 are executed. Since at this stage of operation the key code of tone pitch D1 input as above is stored in X register 7*a*, the display unit 6*i* corresponding to key 2*c* of tone pitch D1 is lit in step S17 (see (c) in FIG. 6). In the subsequent step S18, "1" is added to the content of N register 7*f* which becomes "2" accordingly. In the subsequent step S19, this "2", the content of N register 7*f*, is displayed in the display section 5 (see (c) in FIG. 6). Since the operations of steps S20 to S22 are sequentially carried out thereafter, a tone having the pitch of D1 is generated, in correspondence to the content of X register 7*a*, until the corresponding key 2*c* is released or keyed off (see (c) in FIG. 6).

Figure 6:
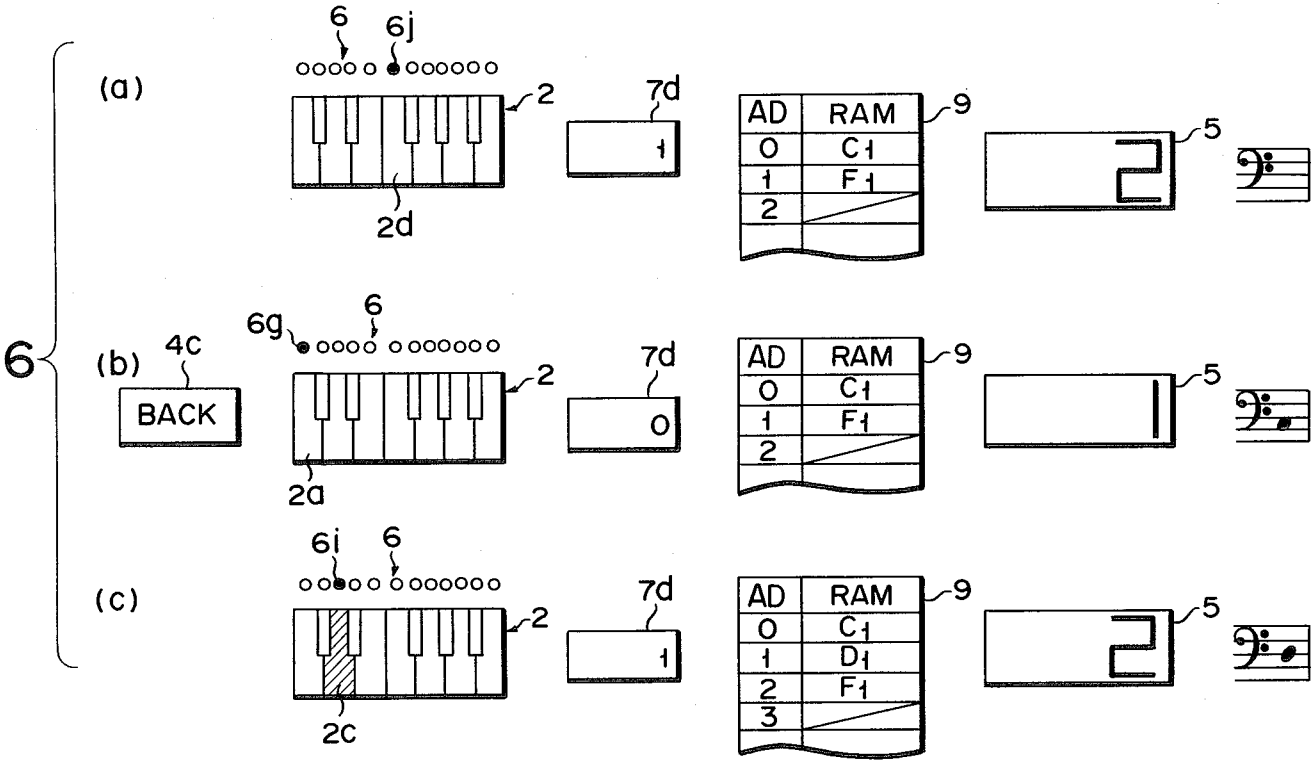
FIGS. 6*a* to 6*c* and FIGS. 7*a* to 7*b* are views similar to those of FIGS. 5*a* to 5*e*, corresponding to the actuation of a backward key.

In this way, when the backward key 4*c* is keyed on under the state shown in (a) in FIG. 6, the content (tone pitch C1) stored in the area of the address immediately preceding (or stepped backward by one address from) the previously read address is informed by its display and sound generation. When the key 2*c* of tone pitch D1 is subsequently keyed on, the contents of the addresses succeeding to the 0 address of the RAM 9 are sequentially shifted forward by one and the key code of tone pitch D1 is inserted into the first address now empty. Accordingly, even if, in case of writing the tone data in accordance with the score of a preselected musical piece, the insertion of some tone data is missed, this data can be easily inserted into its corresponding address.

Figure 7:
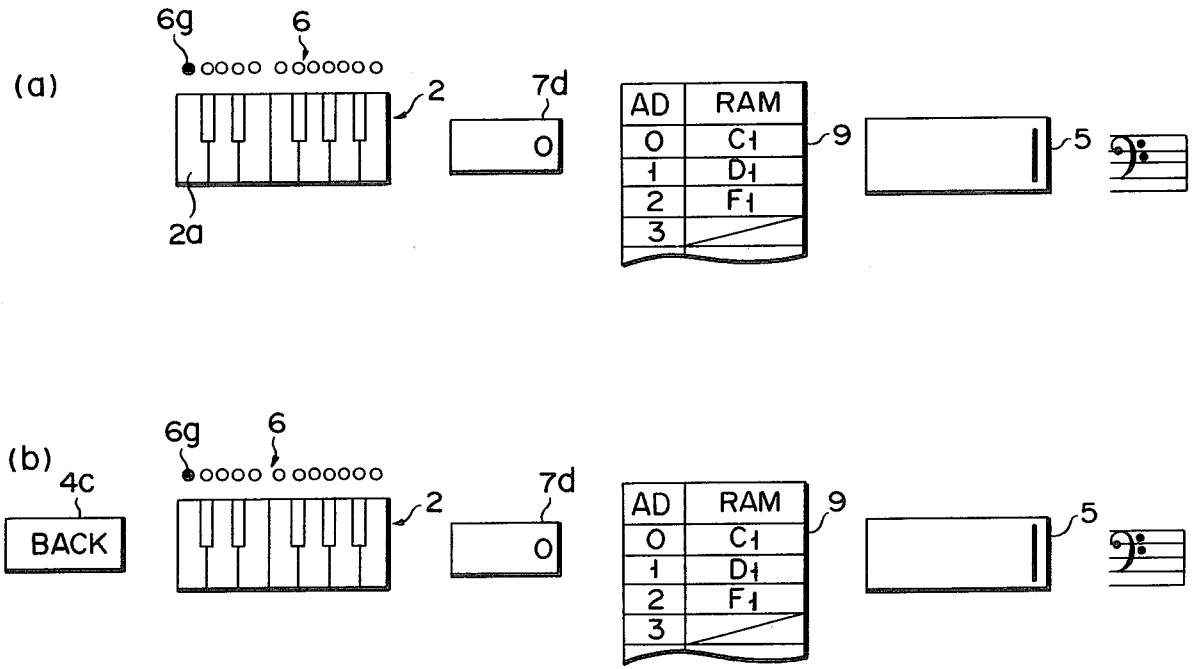

Next, explanation is made with reference to FIG. 7. Assume now that, as shown in (a) in FIG. 7, the key code of tone pitch C1 stored in the 0 address of the RAM 9 is read and the display unit 6*g* corresponding to the key of tone pitch C1 is kept energized. When under this condition the backward key 4*c* is once keyed on, the operation is advanced to step S26 from the step S23. Since at this stage of operation the content of i register 7*d* is "0", the operations under steps S27 to S33 are skipped to perform step S34. As a result, as shown in (b) in FIG. 7, the operational state immediately preceding the actuation of the backward key 4*c* is maintained. This means that under the state wherein the content of the foremost address (0 address) of the RAM 9 is displayed on the display unit 6*g*, an actuation of the backward key 4*c* causes no change in the content of the RAM 9.

Figure 9:
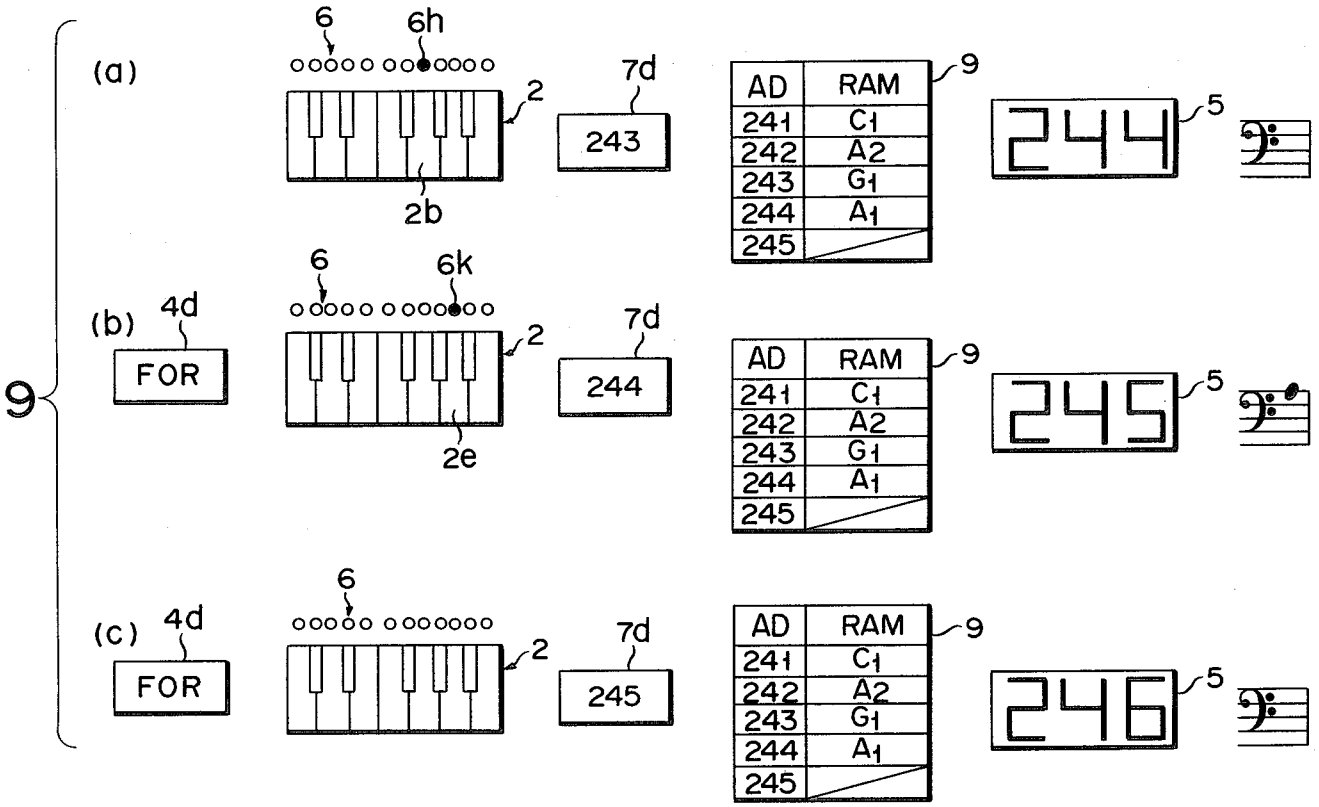
Figure 10:
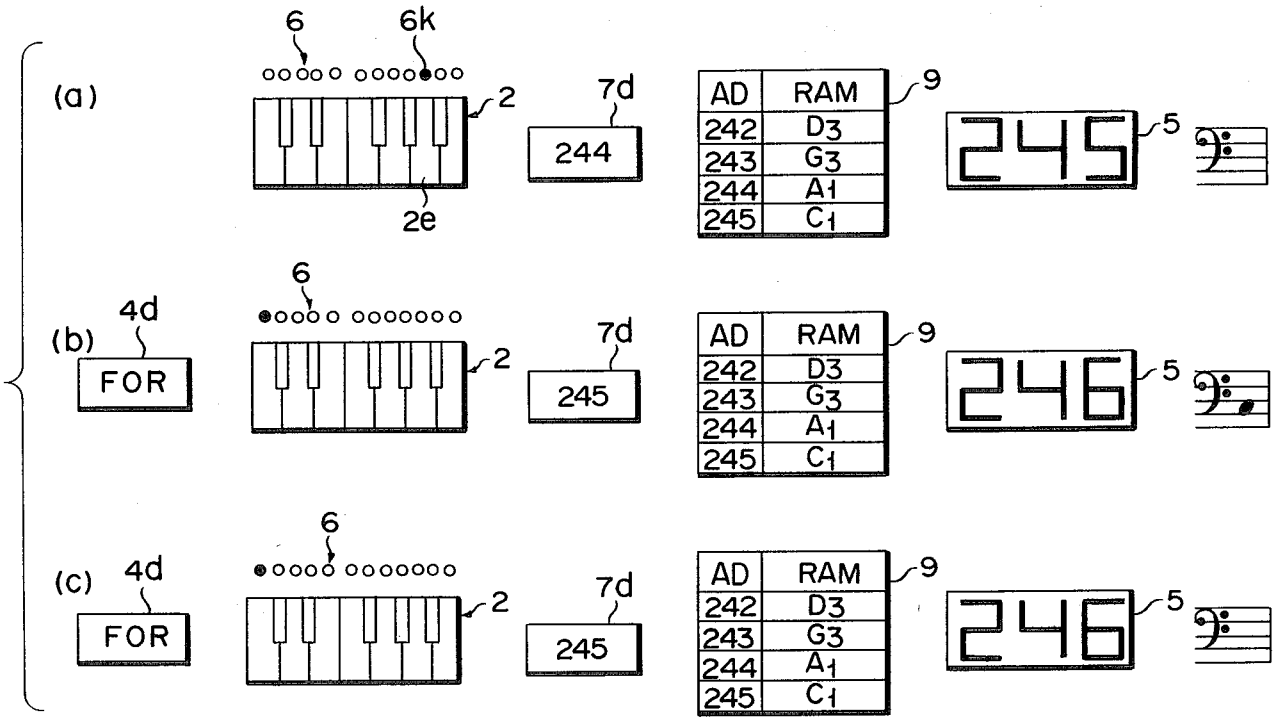

Next, the operation performed when the forward key 4*d* is keyed on will be described in detail with reference to FIGS. 8 to 10. Assume now that, as shown in (a) in FIG. 8, the key code of tone pitch C1 stored in the 0 address of the RAM 9 is read and the display unit 6*g* corresponding to the key 2*a* of tone pitch C1 is kept energized or lit. When in this state the forward key 4*d* is keyed on once or actuated, the operation is advanced to step S35 from step S24, in which step S35 the content of i regiser 7*d* is supplied to the decoder 11 through the gate circuit G1 and is subjected to the "245" judgement. Since at this stage of operation the content of i register 7*d* is "0", the operation is advanced to the next step S36, so as to cause an increment of "1" in the content of i regiser 7*d*. Subsequently, the operation is advanced to step S37, so as to change the content of N regiser 7*f* to "2". Thereafter, the operation is shifted to step S29 from step S37 and the operations under the steps S29 to S34 are sequentially executed. As a result, as shown in (b) in FIG. 8, the key code of tone pitch D1 stored in the first address of the RAM 9 is read, and the display unit 6*i* corresponding to the tone pitch D1 (key 2c) is lit and, simultaneously, the sound having the pitch of D1 is generated until the forward key 4d is keyed off. Simultaneously, the number "2", the step number of the address, is displayed on the display section 5.

When the key 2b of tone pitch G1 is next depressed, the operations of steps S5 to S22 are sequentially carried out. That is, since at this stage of operation the content of N regiser 7f is "2", the operation is advanced to step S6, in which the content of i regiser 7d is increased to "2" (see (c) in FIG. 8). Thereafter, the operation is advanced to step S8 from step S7, and the operations under steps S8 to S16 are performed in turn. As a result, the key code of tone pitch G1 inputted as above is transferred, in step S8, into X register 7a and is then written, in step S10, into the second address of the RAM 9. Further, the key code of tone pitch F1 previously stored in the second address of the RAM 9, after it is allowed to stay in the Y register by the operation of step S9, is written, in step S13, into the third address of the RAM 9. Accordingly, the content of the RAM 9 is as shown in (c) in FIG. 8. After the operations under steps S12 to S16 are subsequently and repeatedly carried out, the operations under steps S17 to S22 are executed. Thus, the display unit 6h corresponding to the key 2b of tone pitch G1 is lit in step S17, and the numeral "3", which is the content of N register 7f increased in the step S18, is supplied in step S19 to the display section 5 to be displayed as the step number. Further, the tone having the pitch of G1 is generated by execution of the step S20 operation.

Figure 8:
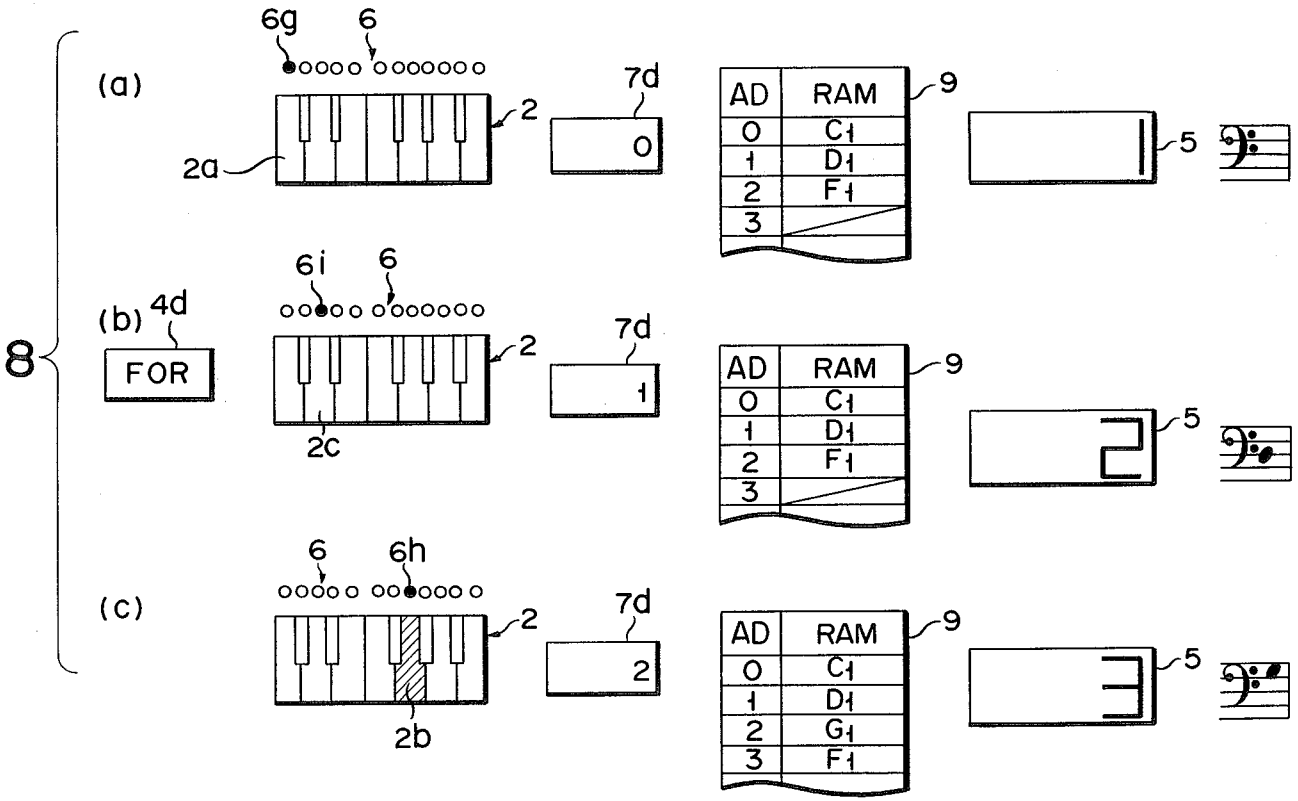
FIGS. 8*a* to 8*c*, FIGS. 9*a* to 9*c* and FIGS. 10*a* to 10*c* are views similar to those of FIGS. 5*a* to 5*e*, corresponding to the actuation of a forward key.

In the above-mentioned way, when the forward key 4d is depressed in the state shown in (a) in FIG. 8, the content (tone pitch D1) stored in the area of an address immediately succeeding to (or forwardly stepped by one address from) the previously read address is made known by its display and sound generation. When the key 2b of tone pitch G1 is subsequently actuated, the contents of the addresses succeeding to the first address of the RAM 9 are advanced by one, respectively, and the key code of tone pitch G1 is written into the second address of the RAM 9, now empty. Accordingly, even if the insertion of some tone data is missed in writing the tone data in accordance with the score of a musical piece, the insertion can be easily carried out without deleting the tone data already inputted.

Next, explanation will be made with reference to FIG. 9. Assume now that, as shown in (a) in FIG. 9, the key code of tone pitch G1 stored in the "243rd" address of the RAM 9 is read and the display unit 6h corresponding to the key 2b of tone pitch G1 is lit. When under this condition the forward key 4d is once actuated, the operation is advanced to step S35 from step S24. Since at this stage of operation the content of i register 7d is "243", the operation is advanced to step S36, so as to cause an increment in the content of i register 7d to "244". And in the next step S37 the content of N register 7f is increased to "245". Subsequently, the operations under steps S29 to S34 are performed in turn. Consequently, the key code of tone pitch A1 stored in the "244th" address of the RAM 9 is read and the display unit 6k corresponding to the key 2e of tone pitch A1 is lit and in addition the step number "245" is displayed on the display section 5. As a result, when in the state shown in (a) in FIG. 9, the forward key 4d is once depressed, the resultant operational state is as shown in (b) in FIG. 9. When the forward key 4d is subsequently actuated once, the data processing is carried out in the same manner as mentioned above. Therefore, the content of i register 7d becomes "245" while the content of N register 7f becomes "246". Since at this stage no data is stored in the address "245" of the RAM 9, none of the display units 6 are lit nor is any sound generated.

Next, the operation of overflow when the forward key 4d is keyed on will be explained in detail with reference to FIG. 10. Assume now that, as shown in (a) in FIG. 10, the key code of tone pitch A1 stored in the "244th" address of the RAM 9 is read and the display unit 6k corresponding to key 2e of tone pitch A1 is energized or lit. When in this state, the forward key 4d is depressed once, the data processing is carried out in the same manner as mentioned above. As a result, the content of i register 7d is increased to "245", with the result that the display and sound generation are made as shown in (b) in FIG. 10. When in this state, the forward key 4d is once more depressed, and the operation is advanced to step S35 from step S24. Since at this stage of operation the content of i register 7d is "245", the signal J1 is outputted from the decoder 10. Further, the operations under steps S36, S37 and S29 to S33 are skipped. Consequently, as shown in (c) in FIG. 10, the display of the display unit 6 indicates no change from that shown in (b) in FIG. 10, nor is any sound generated.

Figure 11:
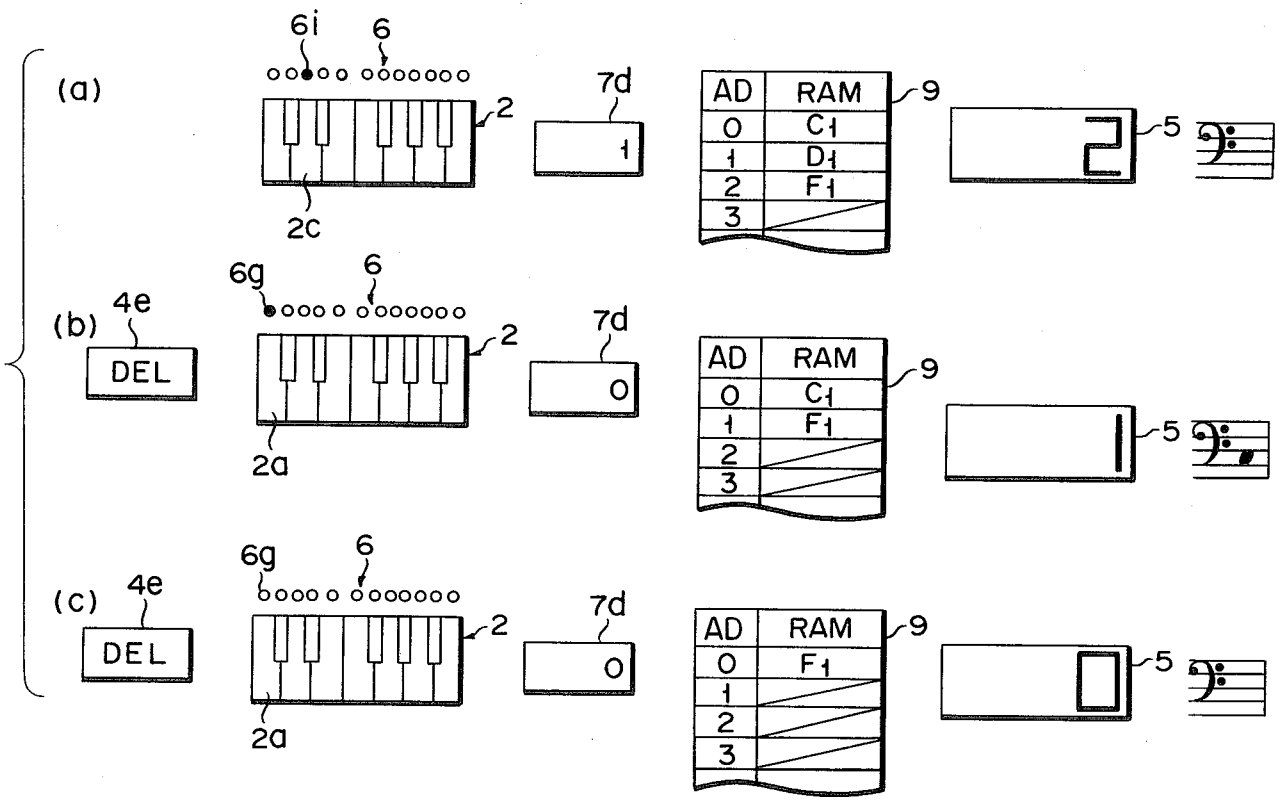
FIGS. 11*a* to 11*c*, FIGS. 12*a* to 12*c* and FIGS. 13*a* to 13*c* are views similar to those of FIGS. 5*a* to 5*e*, corresponding to the actuation of a delete key.
Figure 12:
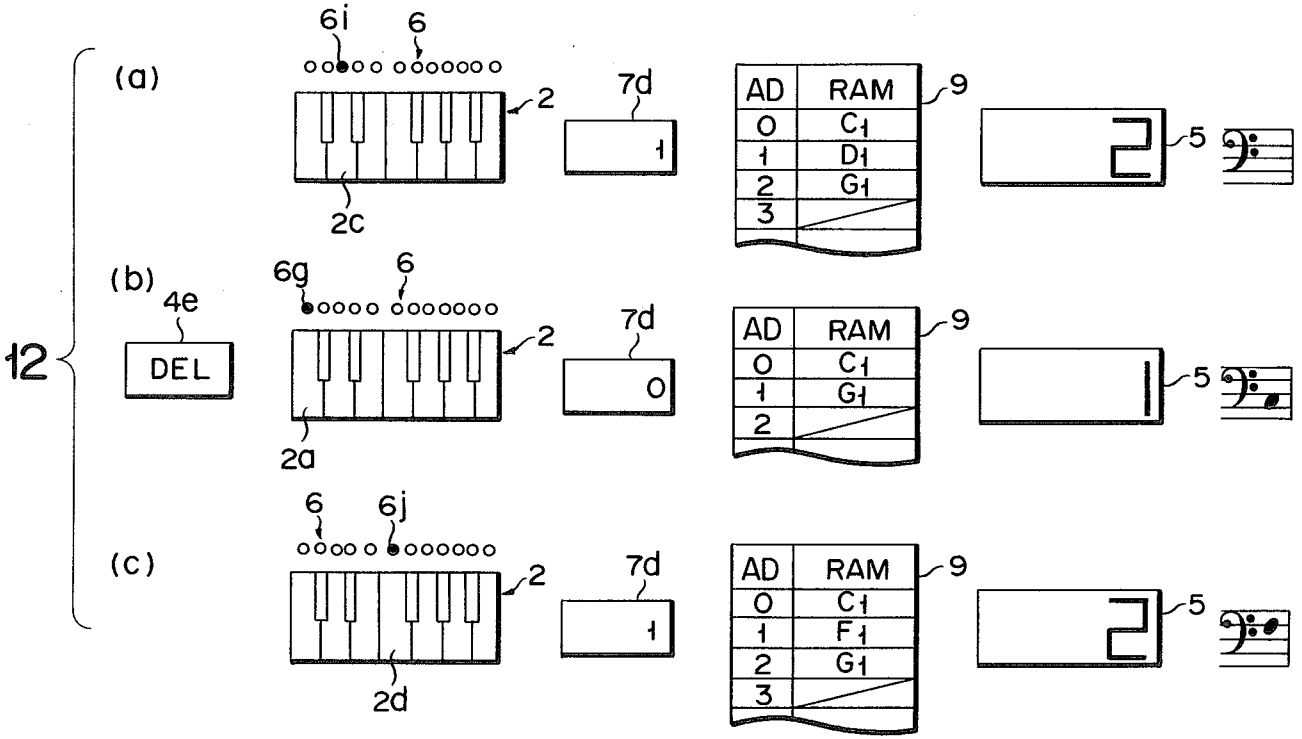
Figure 13:
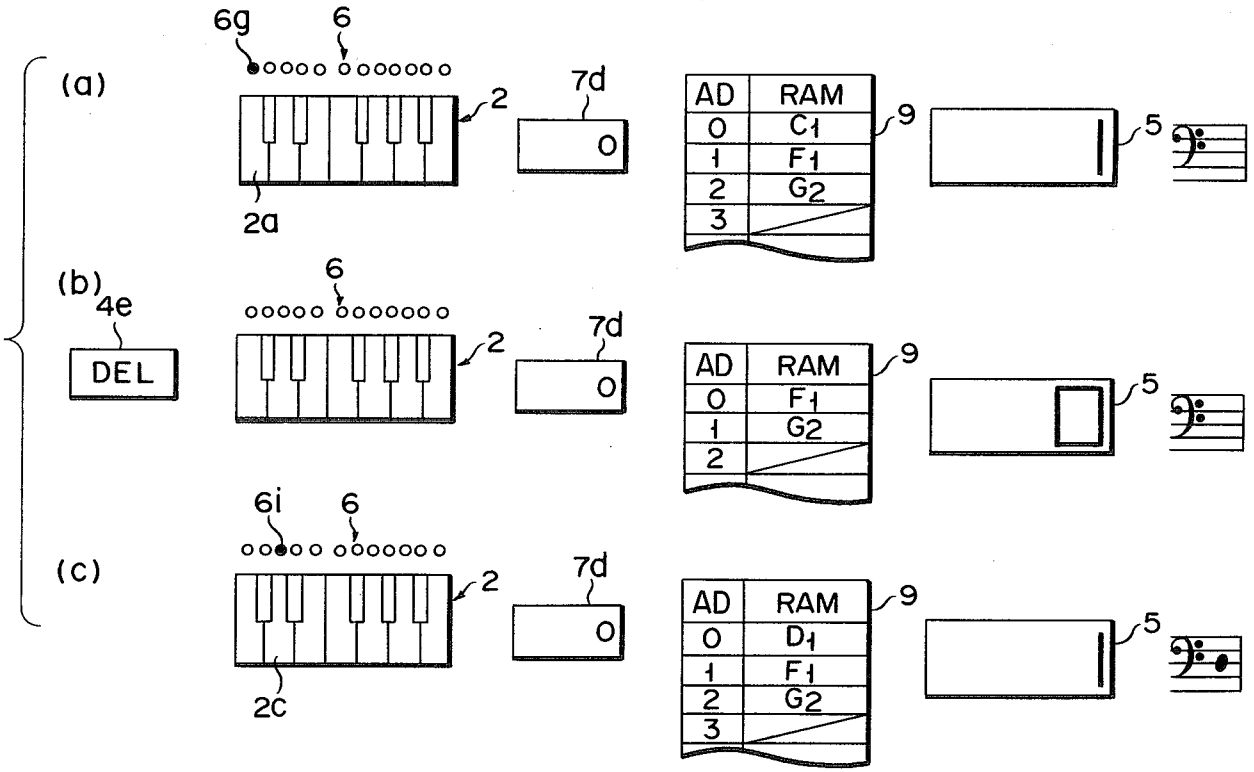

Next, the operation performed when the delete key 4e is actuated will be described in detail with reference to FIGS. 11 to 13. Assume now that, as shown in (a) in FIG. 11, the key code of tone pitch D1 stored in the first address of the RAM 9 is read and display unit 6i corresponding to key 2c of tone pitch D1 is lit. When in this state the delete key 4e is keyed on once, the operation is advanced from step S25 to step S38, in which step the content of i register 7d is subjected to the "0" judgement. Since at this stage of operation the content of i register 7d is "1", the operation is advanced to step S39, in which "1" is subtracted from the content of i register 7d, which thus becomes "0" (see (b) FIG. 11). Subsequently, the operation is advanced to step S40, in which the key code of tone pitch C1 stored in the 0 address of the RAM 9, or the area RAM (i), is transferred to X register 7a. The content of X register 7a is supplied, in step S41, to the tone generator section 13 together with the attack signal AT. As a result, as shown in (b) in FIG. 11, a sound having the pitch of C1 is generated. In the subsequent step S42, the content of X register 7a is supplied to the display unit 6, whereby the display unit 6g corresponding to the key 2a of tone pitch C1 is lit (see (b) in FIG. 11). Next, the operation is advanced to step S43, in which "1" is subtracted from the content of N register 7f which thus becomes "1". This content of N register 7f is supplied, in step S44, to the display section 5, in which "1" is displayed as the step number (see (b) in FIG. 11). The operation is advanced to the next step S45, in which "2" is preset into n register 7e. In the subsequent step S46, the RAM 9 is address-designated by the data "2" obtained by the addition of "2", or the content of n register 7e, to "0", or the content of i register 7d, whereby the key code of tone pitch F1 stored in the second address of the RAM 9 is transferred to X resister 7a. The key code of tone pitch F1 written into the X register 7a is written, in the next step S47, into the area RAM (i+n), namely the first address of the RAM 9 (see (b) in FIG. 11). As a result, the key code of tone pitch F1 which, in the state shown in (a) in FIG. 11, has been stored in the second address of the RAM 9, is shifted backward by one address upon the actuation of the delete key 4e and is thus written into the first address of the RAM 9, while the key code of tone pitch D1 stored in the first address of the RAM 9 in the state shown in (a) in FIG. 11 is deleted. That is, the content of the first address of RAM 9 is rewritten from the key code of D1 to the key code of tone pitch F1. Subsequently, the operation is advanced to the next step S48, in which "1" is added to the content of n register 7e to cause an increment in the same to "3". Subsequently, the operation is advanced to step S49, in which the data obtained by addition of the content of n register 7e to the content of i register 7d is subjected to the "246" judgement. Since at this stage of operation the data in question is "3", the operation is returned to step S46 and the operations S46 to S49 are repeatedly carried out until the data in question becomes "246". Thus, the contents of the second address and its succeeding addresses are shifted backward by one. When the data in question, or the content of the (i+n) registers, becomes "246", the operation is advanced to step S50, in which it is judged whether or not the delete key 4e is keyed off, and is delayed until it is keyed off. When that key is released, the operation is advanced to step S51, in which the release signal RE is output to the tone generator 13 to stop the sound generation of pitch C1. Upon completion of this step S52, the operation is returned to step S4. When at this stage of operation the delete key 4e is keyed on once more, the operation is advanced to step S38 from step S25. Since at this stage of operation the content of the i register 7d is "0", the operation is advanced to step S52, in which "0" is transferred into N register 7f, thereby clearing the previous contents of same. This content of N register 7f is supplied, in the next step S53, to the display section 5, in which, as shown in (c) in FIG. 11, "0" is displayed as the step number. Subsequently, the operation is advanced to step S54, in which the display unit 6g corresponding to the key 2a of tone pitch C1, is extinguished (see (c) in FIG. 11). In the next step S55, "1" is preset to n register 7e. Upon completion of the step S55 operation, step S46 is executed. Since at this stage of operation the content of i register 7d is "0" and the content of n register 7e is "1", the key code of tone pitch F1 stored in the first address of the RAM 9 is transferred, in step S48, into X register 7a and the data previously stored in same is written, in step S47, into the address of the RAM 9 (see (c) in FIG. 11). Thus, the key code of tone pitch C1 stored in the first address of the RAM 9 is rewritten into the key code of tone pitch F1, that is, replaced by the same. Since the operations of steps S46 to S49 are subsequently carried out repeatedly, the contents of the first address and its succeeding addresses of the RAM 9 are each shifted backward by one, or are each shifted to the next address smaller in number. In the state shown in (b) in FIG. 11, that is, when the content of i register 7d is "0", steps S52 to S55 are executed in place of steps S39 to S45, with the result that every one of the display units 6 is extinguished and no sound generation is caused (see (c) in FIG. 11).

Next, explanation will be made with reference to FIG. 12. Assume now that, as shown in (a) in FIG. 12, the key code of tone pitch D1 stored in the first address of the RAM 9 is read and display unit 6i corresponding to key 2c of tone pitch D1 is kept energized. When, in this state, the delete key 4e is actuated, the above-mentioned steps S38 to S51 are sequentially executed, with the result that the operational status is as shown in (b) in FIG. 12. When, in this state, the key 2d of tone pitch F1 is actuated, steps S4 to S22 are sequentially executed. That is, since at this stage of operation the content of N register 7f is "1", the operation is advanced to the step S6, in which the content of i register 7d is increased to "1" (see (c) in FIG. 12). Subsequently, steps S8 to S16 are sequentially performed, with the result that the key code of tone pitch F1 input as above is transferred, in step S8, into X register 7a and is then written, in step S10, into the first address of the RAM 9. The key code previously stored in the first address of the RAM 9, after being allowed in step S9 to stay in Y register 7b, is written into the second address of the RAM 9 by the operation of step S13. For this reason, the content of the RAM 9 is as shown in (c) in FIG. 12. Accordingly, through a repeated execution of steps S12 to S16, the contents of the second address and its succeeding addresses of the RAM 9 are each shifted forward by one. Through a subsequent execution of steps S17 to S22, as shown in (c) in FIG. 12, the display section 5 displays the increased content of N register 7f, the display unit 6j corresponding to key 2d of tone pitch F1 is lit, and a sound having the pitch of F1 is generated.

Next, explanation will be made with reference to FIG. 13. Assume now that, as shown in (a) in FIG. 13, the key code of tone pitch C1 stored in the 0 address of the RAM 9 is read and the display unit 6g corresponding to the key 2a of tone pitch C1 is kept energized. When, in this state, the delete key 4e is depressed, the operation is advanced to step S38 from step S25. Since at this stage of operation the content of i register 7d is "0", the operation of steps S52 to S55 and S46 to S51 is executed in turn, with the result that, as shown in (b) in FIG. 13, every one of the display units 6 is kept unlit with no sound generation. When, in this state, the key 2c of tone pitch D1 is actuated, the operation is advanced to step S7 from step S5 and the operation of steps S7 to S22 is then executed in turn. As a result, as shown in (c) in FIG. 13, the key code of tone pitch D1 now input as above is written into the 0 address of the RAM 9, the key code of tone pitch F1 previously stored in the 0 address is shifted to the address "1", and the key code of tone pitch G2 previously stored in the address "1" is shifted to the address "2" of the RAM 9.

In this way, when the delete key 4e is depressed, the content stored in the area of an address preceding immediately to the present address made known by its display and sound generation, and at the same time the content of the area before the actuation of the delete key 4e is deleted and the contents of its succeeding address areas are each shifted backward by one address. Further, when actuating the keyboard 2 after actuating the delete key 4e, the content corresponding to the actuated key can be inserted in place of the content deleted by the delete key. Accordingly, when writing the tone data in accordance with the progress in score of the musical piece, even if superfluous tone data is written, such data can be deleted. Simultaneously, even if some tone data, is miswritten, the data can be corrected to the correct tone data. Further, when actuating the delete key 4e, the content stored in the address area immediately succeeding to the previously read address can be also displayed with sound generation made in correspondence thereto.

The above-mentioned embodiment refers to the use of the backward key, forward key and delete key in correcting, inserting and deleting the content of the RAM 9, but the invention is not limited to these particular keys and permits the use of other types of keys. Further, the above-mentioned embodiment includes the use of lighting the display unit 6 disposed in the proximity of a certain key when actuating that key. However, the invention would also permit the display unit to be flickered in such a case.

As stated above, the invention is constructed such that when correcting, inserting, and deleting tone data stored in a memory, the address in question in the memory is manually renewed with regard to its content; and the content of the address thus renewed is read out to inform, visually and aurally, the pitch of the corresponding tone. The invention, therefore, permits an easy confirmation of, for example, a correction portion through such visual and audible signaling to the user, and thus enables an easy and quick performance of the correcting operation.

What is claimed is:

1. An electronic musical instrument comprising:

means for sequentially inputting a series of tone data corresponding to a pre-selected musical piece;

memory means, including a number of memory positions, each having a corresponding address, for storing sequentially in a plurality of said memory positions the tone data inputted from said inputting means;

address designation renewing means, for designating and modifying an address indicating where said tone data have been stored in said memory means, said address designation renewing means comprising:

manually operable first means, for incrementing, in response to a manual operation, the designation address of the data-containing memory positions of said memory means; and manually operable second means, for continuously decrementing, in response to successive manual operations, a plurality of the designation addresses of the data-containing memory positions of said memory means;

tone generator means for generating a tone corresponding to the tone data stored in a memory position, the address of which has been modified by said address designation renewing means;

manually operable delete means coupled to said memory means, for deleting, in response to a manual operation, tone data stored in a memory position of said memory means, the address of which position is designated by said address designation renewing means; and means responsive to deletion by said delete means of said tone data stored in said designated address for automatically causing said tone generator means to generate a tone corresponding to the tone data in a memory position address which differs by one from said designated address.

2. An electronic musical instrument according to claim 1, including a CPU for controlling operations of said inputting means and said address designation renewing means.

3. An electronic musical instrument according to claim 1, including display means for indicating the memory position address modified by said address designation renewing means.

4. An electronic musical instrument according to claim 1, wherein said inputting means includes a plurality of keys, each designating a predetermined pitch of a musical tone, and comprising a plurality of display units, each corresponding to one of said keys, respectively, and means for energizing said display units in accordance with pitch data associated with tone data read out from a memory position, the address of which tone data has been modified by said address designation renewing means.

5. An electronic musical instrument according to claim 1, which comprises means for sequentially backwardly shifting, by the extent corresponding to the tone data deleted by actuation of said delete means, the tone data in the memory positions of said memory means which have addresses succeeding to the addresses of the memory positions having their contents deleted.

6. An electronic musical instrument according to claim 1, which comprises means for sequentially forwardly shifting the tone data stored in the memory position, the address of which tone data is modified by said address designation renewing means, together with the tone data stored in the memory positions having succeeding addresses, and means for writing desired tone data into a memory position made empty by said sequential and forward shifting operation.

* * * * *

UNITED STATES PATENT AND TRADEMARK OFFICE

CERTIFICATE OF CORRECTION

PATENT NO. : 4,622,879

DATED : November 18, 1986

INVENTOR(S) : AKINORI MATSUBARA

It is certified that error appears in the above-identified patent and that said Letters Patent is hereby corrected as shown below:

IN THE TITLE PAGE:

Under the heading "References Cited", include the following reference:

--3,047,801 10/1981 Fed. Rep. of Germany--

Signed and Sealed this

Twenty-third Day of February, 1988

*Attest:*

DONALD J. QUIGG

*Attesting Officer*

*Commissioner of Patents and Trademarks*